US005249631A

United States Patent [19]

Ferren

[11] Patent Number: 5,249,631

[45] Date of Patent: Oct. 5, 1993

[54] WATER POWERED MOBILE ROBOT

[76] Inventor: Bran Ferren, 615 Fireplace Rd., East Hampton, N.Y. 11937

[21] Appl. No.: 356,442

[22] Filed: May 24, 1989

[51] Int. Cl.[5] ..... A62C 27/00

[52] U.S. Cl. ..... 169/52; 169/24; 239/587.1; 239/747; 901/1

[58] Field of Search ..... 169/52, 24; 901/1, 43; 239/747, 587, 587.1

[56] References Cited

U.S. PATENT DOCUMENTS

| | | | |
|---|---|---|---|
| 932,240 | 8/1909 | Beale et al. | 169/24 X |
| 2,360,397 | 10/1944 | Carpenter | 169/24 |
| 3,155,319 | 11/1964 | Hammelmann | 169/24 X |
| 3,460,761 | 8/1969 | Tuck | 239/747 X |
| 3,628,674 | 12/1971 | Koike | 901/1 X |
| 3,724,554 | 4/1973 | Rupert et al. | 169/24 X |
| 4,226,366 | 10/1980 | Nörtoft | 239/747 X |
| 4,762,478 | 10/1983 | Cummins | 169/24 |
| 4,817,653 | 4/1989 | Krajicek et al. | 901/1 X |
| 4,821,665 | 4/1989 | Matthias et al. | 901/1 X |

FOREIGN PATENT DOCUMENTS

| | | | |
|---|---|---|---|
| 901043 | 5/1972 | Canada | 239/747 |
| 1292497 | 4/1969 | Fed. Rep. of Germany | 169/52 |
| 2269856 | 12/1975 | France | 239/747 |
| 1191449 | 5/1970 | United Kingdom | 169/24 |
| 2034162 | 6/1980 | United Kingdom | 239/747 |

*Primary Examiner*—David M. Mitchell
*Assistant Examiner*—Andrew C. Pike
*Attorney, Agent, or Firm*—Darby & Darby

[57] ABSTRACT

A mobile robot is provided with a fluid conduit which is connected to an on board fluid-responsive turbine. An on board electric generator and/or hydraulic pump is connected to the mechanical output of the turbine such that power for the robot is generated when the turbine rotates due to the flow of fluid through the conduit. The fluid may then be expelled through a nozzle and used as an extinguishant, a propellant or a coolant.

8 Claims, 1 Drawing Sheet

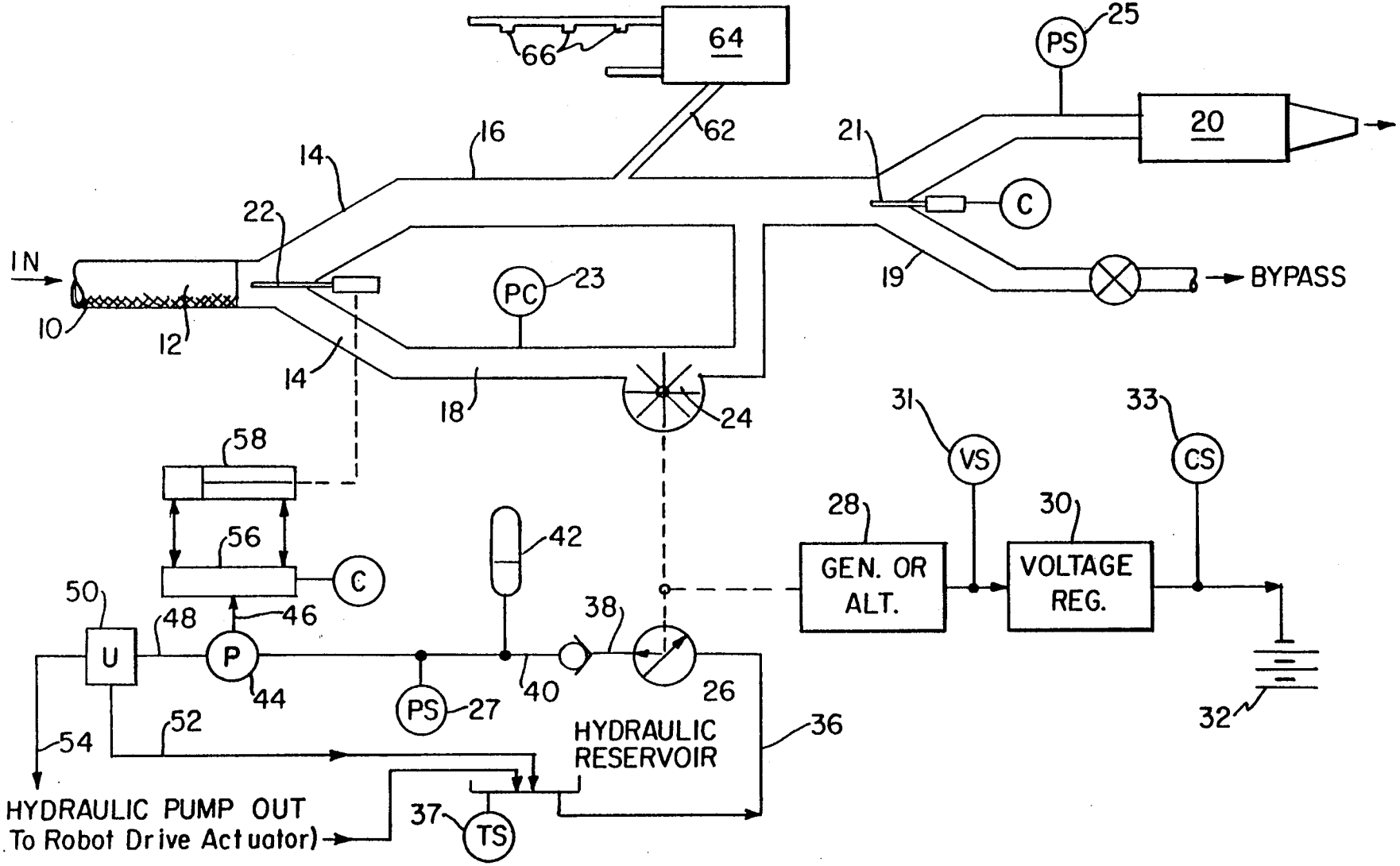
BYPASS
20
25
PS
C
21
19
64
62
66
16
14
22
12
10
IN
23
PC
24
18
14
32
33
CS
30
VOLTAGE REG.
31
VS
28
GEN. OR ALT.
36
26
HYDRAULIC RESERVOIR
38
42
40
27
PS
37
TS
C
46
58
56
44
P
48
52
50
U
54
HYDRAULIC PUMP OUT
To Robot Drive Actuator)

WATER POWERED MOBILE ROBOT

This invention relates to mobile robots, more specifically, this invention relates to a water powered mobile robot of particular utility in fighting fires.

BACKGROUND OF THE INVENTION

A major barrier to the maneuverability of mobile robots is the inadequate performance of available power supplies. Mobile robots generally require a long-term stable power supply for the normal-load operation of robot control electronics and hydraulic and mechanical systems. For many applications of mobile robots additional power is required to satisfy short-term, high-load functions such as high-speed effector positioning, high-torque mobility and high speed propulsion.

One such application is fire fighting. This typically involves passing an extinguishing fluid to a mobile robot through a hose and expelling it through a nozzle towards a fire at a relatively high velocity and volume. The fluid which is forced through the hose to be directed towards a fire is typically water and AFFF, CO2 or Halon and Nitrogen. Once activated, the robot can be preprogrammed to detect intense heat and to direct the flow of extinguishant towards the hottest-point, or the robot can be maneuvered and controlled by personnel from a distance using a radio-controlled device. Fire fighting robots require both long term and high-load power.

Another application involves robots for underwater maneuvers for use during hazardous testing and exploring and rescue missions which typically take place in the oceans. These robots are usually powered by an electric umbilical or an on-board battery and are controlled by sonic transmission or by way of additional wires within the umbilical. Long-term power is desired.

Another application involves the handling of heavy loads which are potentially dangerous in themselves, such as toxic chemicals or explosives. These mobile robots have high power requirements and a long term power supply is desired.

In the field of mobile robots, conventional power sources are generally either of two types; self-contained on-board power units (such as batteries) and remote (non-mobile) power supplies which feed the necessary power to the robot through an electric umbilical cord.

Conventional on-board power supplies include various types of batteries (such as lead acid, NiCad, silver zinc, carbon and mercury), fuel cells, internal combustion engines, gas turbines, thermal batteries, pressurized gas accumulators, photovoltaic cells, mechanical potential systems (such as springs) and thermopile systems involving hydrocarbon or nuclear energy inputs.

The problems associated with these power sources include: inadequate long-term power and/or peak power capacity, poor power to weight ratio and/or excessive bulk, excessive cost, poor shelf life, and possible personal safety hazards. For example, if on-board batteries were used to power a fire fighting mobile robot, although they could provide adequate peak power they would fail to satisfy the long term power requirements and the robot would therefore be unable to fight a fire for long periods of time. The batteries would spend their stored charge and would require time consuming re-charging. Batteries would also have a poor power to weight ratio, a poor shelf life, excessive maintenance requirements and are potentially dangerous if heated due to the fire fighting environment.

Fuel cells could provide long-term low load power, but not short-term high load power. Fuel cells would also be excessively heavy, expansive and also dangerous to operate owing to the combustible nature of the fuels commonly used with them.

Photovoltaic cells, if used would be too expansive, could not effectively provide either long-term low load power or short-term high load power without charging batteries, could be easily damaged, for example, in a fire fighting environment and in some low-light robot applications such as underwater maneuvers these cells would not operate effectively.

Although an electrical umbilical cord could supply the necessary high load and long-term power demands, these cords are vulnerable to damage from the intense heat of a fire fighting environment, corrosion from an ocean environment and deterioration from a chemical environment. A potentially significant personnel hazard exists if an umbilical cord were to leak current. The damaged umbilical could short circuit and spark, possibly creating unexpected fires and explosions in addition to a loss of robot power. Further, these cords are commonly heavy and cumbersome and will restrict the flexible maneuverability of the robot.

Any on-board power generating system involving an isolated on-board supply of combustible fuel such as an internal combustion engine burning diesel fuel or gasoline and thereafter generating the necessary electrical and/or hydraulic pressure requirements posses potential safety hazards if the robot is in a typical fire fighting environment and is not convenient for powering robots in an underwater environment owing to the lack of oxygen available for combustion. Further, these powering systems will only operate for as long as the fuel supply will permit. This could be costly should the fuel supply of such an on-board power generating system be depleted before the operating robot is maneuvered to a position where the fuel supply can be safely replenished. The entire robot could be lost due to inaccessibility or damaged due to extreme heat or underwater pressures if this were to occur while fighting a fire or during underwater maneuvers.

OBJECTS OF THE INVENTION

It is a general object of the invention to provide a method of effectively powering a mobile robot which overcomes the aforementioned problems.

It is a more specific object of the present invention to provide a safe method of effectively powering a mobile robot which has access to flowing fluid.

It is a further object of the present invention to provide a safe, effective and efficient power supply system for a mobile robot which also protects the robot and its components from heat or chemical damage from its working environment.

SUMMARY OF THE INVENTION

The present invention provides an efficient power supply system for a mobile robot which includes a fluid umbilical. According to the invention, a turbine is integrated with the flow of fluid in the umbilical such that rotational energy is derived. The rotating turbine turns an on-board electric generator and/or a hydraulic pump thereby generating from the flowing fluid the power necessary for robotic movements. The flow of fluid from the turbine may be used as an extinguishant in a fire fighting environment, or for underwater related applications, the fluid can be used to propel and maneuver the robot.

DESCRIPTION OF THE DRAWINGS

The drawing is a flow schematic illustrating the present invention.

DETAILED DESCRIPTION OF THE INVENTION

The application of mobile robots for fighting fires is particularly well suited for the preferred embodiment and will therefore be hereinafter incorporated with this detailed description of the invention. Water is used as the extinguishant.

A water supply 10 is fed under relatively high pressure using conventional means (not shown) through a flexible hose 12, the construction and size of which depends on the specific environment which is to be protected against fire. An ordinary canvas-covered, collapsible firehose may be used with the preferred embodiment. A hose fitting (not shown) is used to connect the hose 12 to the robot plumbing 14. The robot plumbing 14 branches off into two main paths 16 and 18. The larger path 16 continues to a conventional fire nozzle 20. The flow of water through the nozzle 20 is controlled by a conventional central controlling means (not shown) by adjusting the valve 21. A bypass branch 19 is connected to path 16 before the nozzle 20. This bypass branch 19 is directly controlled by a valve 21 which is controlled by the central controlling means.

A conventional servo flow control valve 22 is located at the point where the two paths 16 and IS separate. Valve 22 controls the amount of fluid delivered through each path. Pressure sensors 23 is located along path 18, before the turbine and pressure sensor 25 is located along path 16 before the bypass branch 19, for indicating the water pressure at these points.

A water turbine 24 located along the path 18, turns when water flows through path 18. The water output of this turbine 24 continues along path 18 which re-connects with path 16 before nozzle 20. The mechanical output of the turbine 24 is connected to either a conventional hydraulic delivery pump 26, a conventional electric generator (or alternator) 28 or both, depending on the type of robot used.

The generator 28 is electrically connected to the input of a voltage regulator 30, the output of which is electrically connected to conventional rechargeable batteries 32. These batteries 32 are continuously kept fully charged by an external electrical source during times when no fire is present to be extinguished so that when the robot is activated it begins its fire fighting operations immediately using the stored charge in the batteries 32. When water from source 10 begins to flow, additional power is supplied by pump 26 and/or generator 28, and the external battery charging circuit may be disconnected from the robot. A voltage sensor 31 and a current sensor 33 are electrically connected to the input and output terminals of the regulator 32, respectively. These sensors 31 and 33 inform the central controller (not shown) of the voltage and current status of the charging circuit. The electrical connections of the charging circuit which includes the generator 28, the regulator 30 and the batteries 32, are well known.

The hydraulic pump 26 may be a conventional variable delivery pump which is controlled by the rotational rate of the turbine 24. A hydraulic reservoir 34 supplies pump 26 with conventional hydraulic fluid or any other working fluid (such as water) by way of path 36. Temperature sensor 37 is incorporated with the reservoir such that the temperature of the hydraulic fluid is measured. This fluid is forced past a one-way valve 38 along hydraulic line 40. Line 40 may be conventional high pressure hydraulic line. Branching off of line 40 is a conventional fluid accumulator 42 for maintaining a hydraulic pressure potential. This accumulator 42 can be the trapped gas or the spring-bias diaphragm type. A pressure sensor 27 branches off line 40 and provides an indication of hydraulic fluid pressure. A union 44 divides the line 40 into two smaller lines 46 and 48 of equal pressure. Line 48 continues to a conventional unloading valve 50 from which two lines 52 and 54 leave. The flow of hydraulic fluid through each line 52 and 54 is controllable. Line 52 returns excess hydraulic fluid to the hydraulic reservoir 34. Line 54 provides hydraulic pressure for the various conventional hydraulic actuators (not shown) of the robot and is later returned to the hydraulic reservoir 34.

Line 46 leaves union 44 and is attached to a conventional hydraulic servo valve 56 which controls a conventional flow regulator/actuator 58. The valve 56 is controlled by the central controlling means.

The mechanical output of actuator 58 is connected directly to valve 22, thereby directly controlling the amount of flowing water 10 in each path 16 and is.

Another fluid line 62 is tapped into the path 16 and provides fluid pressure for a cooling system which protects the batteries 32 and robot circuitry (not shown) from excessive heat that might otherwise damage them. Also included in the cooling system are low volume, high pressure spray nozzles 66 which are positioned around the exterior of the robot and provide external surface protection from both heat and chemical contact depending on the working environment of the robot. The fluid flow through the spray nozzles 66 is controlled by a variable fluid regulator 64 which is in turn controlled by the controller.

In operation, suppose a fire has ignited the starboard side of a ship which is equipped with fire fighting robots powered by the present power supplying system.

An on board fire fighting robot is activated using appropriate commands from the central controller located, for example in the bridge of the ship. A pump (or the like) is activated to pump sea water to be used as the extinguishant through the hose 12, and the robot is maneuvered to a fire fighting position using the power stored in the batteries 32. The controller in the bridge directs all the water through the nozzle 20 by adjusting valve 21. The valve 22 rests in the halfway position so that when the water reaches the robot plumbing, a portion will flow through path 18 and begin to turn turbine 24. The hydraulic pump 26 will turn and the hydraulic fluid pressure in lines 40, 46 and 48 as well as in the accumulator 42 will increase so that the hydraulic actuators (not shown) of the robot are operational when activated by the robot circuitry and the central controller (not shown).

The mechanical output of the turbine 24 will also cause the electric generator 28 to turn thereby supplying to the regulator 30 sufficient power to operate the robot's electrical requirements including continuously charging the batteries 32 under normal load conditions. Sensors 31 and 33 will indicate to the central controller the output of the generator and the power consumed by the robot. If the robot requires more electrical power then that provided by the turbine 24, the controller will adjust the hydraulic servo valve 56 so that the flow regulator/actuator 58 will mechanically reposition valve 22 which will divert more fluid volume through path 18 to turn turbine 24 faster and stronger, thereby meeting the high-load electrical power requirements.

Similarly, if sensor 27 indicates to the controller a decrease in hydraulic pressure due to high load hydraulic power demand, the controller will accommodate by adjusting the valve 22, as before, to provide the turbine 24 and thereby the hydraulic pump 26 with the necessary power increase to meet the high load hydraulic power demands. The temperature measured by sensor 37 is used to determine critical temperatures and levels of expansion of the hydraulic fluid.

The position of the servo flow control valve 22 can be changed by the action of the actuator 58 in the event that a greater water pressure is required through the nozzle 20, regardless of the power demands of the robot.

The valve 21 is adjusted to divert the flow of extinguishant through the bypass in the event that the flow is restricted at the nozzle 20 or that it is undesirable to expel extinguishant through the nozzle 20 such as moving from one fire to a distant fire or moving after the fire is extinguished. It is important that during a fire emergency the flow of extinguishant continues within the robot plumbing 14, either through the nozzle 20 or the bypass path 19 so that sufficient power to meet high load demands can be readily generated by adjusting valve 22 and directing the flow through path 18 past the turbine 24. The fluid expelled from the bypass branch 19 is either dumped immediately from the robot or is rerouted to the fluid source by another hose.

What is claimed is:

1. A mobile robot comprising:

a fluid conduit, means connected to said fluid conduit for generating electric power in response to fluid flow through said conduit, said generating means located on board said mobile robot, means responsive to said power generating means for operating said mobile robot and means on board said mobile robot for producing hydraulic pressure of an hydraulic fluid, said hydraulic fluid operating on board hydraulic actuators.

2. The mobile robot according to claim 1 wherein said electric power generating means comprises an on board turbine integrated with said fluid conduit for producing electric power for said mobile robot and wherein said means for producing hydraulic pressure comprises an hydraulic pump connected to said turbine.

3. The mobile robot according to claim 2 wherein said on board turbine is connected to an on board electric generator for producing electric power to operate said robot, said generator operating in response to rotation of said turbine.

4. The mobile robot according to claim 2 wherein said fluid conduit further comprises a fluid outlet located after said on board turbine such that said fluid operates said turbine before reaching said outlet.

5. The mobile robot according to claim 4 wherein said fluid is a fire extinguishant and said outlet is a fire fighting type nozzle, said nozzle positioned such that said flowing extinguishant operates said turbine to power said robot before said extinguishant is forced out of said nozzle to extinguish a fire.

6. The mobile robot according to claim 2 further comprising means for diverting said flowing fluid along a first and second path, said first path directing said fluid to operate said turbine, said second path directing said fluid to an outlet.

7. The mobile robot according to claim 6 further comprising means for controlling the amount of flowing fluid diverted along said first and second path, thereby controlling the amount of power said turbine develops from said flowing fluid.

8. The mobile robot according to claim 1 further comprising means for storing electric power generated by said electric power generating means.

* * * * *